US008855542B2

(12) United States Patent
Sone et al.

(10) Patent No.: US 8,855,542 B2
(45) Date of Patent: Oct. 7, 2014

(54) FUSER, IMAGE FORMING APPARATUS, AND IMAGE FORMING METHOD

(75) Inventors: Toshihiro Sone, Kanagawa (JP); Tadashi Noguchi, Shizuoka (JP); Kazuhiko Kikuchi, Kanagawa (JP); Satoshi Kinouchi, Tokyo (JP); Masahiro Doi, Shizuoka (JP); Shuji Yokoyama, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 63 days.

(21) Appl. No.: 13/591,004

(22) Filed: Aug. 21, 2012

(65) Prior Publication Data

US 2013/0051877 A1 Feb. 28, 2013

Related U.S. Application Data

(60) Provisional application No. 61/528,049, filed on Aug. 26, 2011, provisional application No. 61/563,006, filed on Nov. 22, 2011, provisional application No. 61/563,008, filed on Nov. 22, 2011.

(51) Int. Cl.
*G03G 15/20* (2006.01)

(52) U.S. Cl.
CPC ..... *G03G 15/2053* (2013.01); *G03G 15/2078* (2013.01); *G03G 2215/2016* (2013.01); *G03G 15/2064* (2013.01)
USPC ..... 399/329

(58) Field of Classification Search
CPC ..... G03G 15/20; G03G 15/2064; G03G 2215/2016; G03G 15/2078; G03G 15/2053
USPC ..... 399/329
See application file for complete search history.

(56) References Cited

U.S. PATENT DOCUMENTS

| | | | | |
|---|---|---|---|---|
| 3,965,334 | A * | 6/1976 | Asselman et al. | 219/399 |
| 5,596,397 | A * | 1/1997 | Shimada et al. | 399/335 |
| 5,773,796 | A * | 6/1998 | Singer et al. | 219/470 |
| 6,236,830 | B1 * | 5/2001 | Hoberock et al. | 399/330 |
| 6,708,407 | B2 * | 3/2004 | Leinonen et al. | 29/895.32 |
| 7,362,995 | B2 * | 4/2008 | Nuita | 399/329 |
| 7,425,691 | B2 * | 9/2008 | Kinouchi et al. | 219/619 |
| 7,466,950 | B2 * | 12/2008 | Matsuura et al. | 399/328 |
| 7,594,329 | B2 * | 9/2009 | Nuita | 29/895.2 |
| 7,697,881 | B2 * | 4/2010 | Hayashi et al. | 399/399 |
| 7,801,457 | B2 * | 9/2010 | Seo et al. | 399/69 |

(Continued)

OTHER PUBLICATIONS

U.S. Appl. No. 13/482,881, filed May 29, 2012.

*Primary Examiner* — Clayton E Laballe
*Assistant Examiner* — Kevin Butler
(74) *Attorney, Agent, or Firm* — Patterson & Sheridan LLP

(57) ABSTRACT

Certain embodiments provide a fuser including a cylindrical fixing belt, a heating member, an auxiliary heat generating member, a plurality of heat pipes, a pressurizing pad, and a pressurizing roller. The heating member heats the fixing belt. The auxiliary heat generating member auxiliary heats the fixing belt. The plural heat pipes are sparsely arranged in the center in the longitudinal direction of the auxiliary heat generating member and more densely arranged at the ends in the longitudinal direction of the auxiliary heat generating member than in the center. The pressurizing pad is arranged on the inside of the fixing belt. The pressurizing roller is arranged in contact with the outer circumference of the fixing belt. The pressurizing roller presses the fixing belt against the pressurizing pad.

18 Claims, 11 Drawing Sheets

(56) References Cited

U.S. PATENT DOCUMENTS

| | | | | |
|---|---|---|---|---|
| 7,817,952 | B2 * | 10/2010 | Seo et al. | 399/328 |
| 7,860,414 | B2 * | 12/2010 | Itoh et al. | 399/33 |
| 7,912,413 | B2 * | 3/2011 | Murakami | 399/329 |
| 8,014,711 | B2 * | 9/2011 | Ito et al. | 399/328 |
| 8,521,065 | B2 * | 8/2013 | Kikuchi et al. | 399/122 |
| 8,543,046 | B2 * | 9/2013 | Seo et al. | 399/338 |
| 2003/0029603 | A1 * | 2/2003 | Yamashita et al. | 165/89 |
| 2003/0181303 | A1 * | 9/2003 | Leinonen et al. | 492/46 |
| 2006/0222423 | A1 * | 10/2006 | Dejong et al. | 399/333 |
| 2007/0095820 | A1 * | 5/2007 | Kinouchi et al. | 219/619 |
| 2007/0127958 | A1 * | 6/2007 | Matsuura et al. | 399/328 |
| 2007/0212089 | A1 * | 9/2007 | Seo et al. | 399/55 |
| 2007/0242988 | A1 * | 10/2007 | Seo et al. | 399/328 |
| 2008/0025773 | A1 * | 1/2008 | Ito et al. | 399/333 |
| 2008/0063445 | A1 * | 3/2008 | Imai et al. | 399/333 |
| 2008/0181642 | A1 * | 7/2008 | Kishi | 399/69 |
| 2008/0226324 | A1 * | 9/2008 | Baba et al. | 399/69 |
| 2008/0302785 | A1 * | 12/2008 | Kinouchi et al. | 219/619 |
| 2009/0067903 | A1 * | 3/2009 | Yokoyama et al. | 399/330 |
| 2009/0101635 | A1 * | 4/2009 | Yokoyama et al. | 219/619 |
| 2009/0103958 | A1 * | 4/2009 | Takai et al. | 399/330 |
| 2009/0226201 | A1 * | 9/2009 | Kinouchi et al. | 399/69 |
| 2009/0232565 | A1 * | 9/2009 | Yasuda et al. | 399/328 |
| 2010/0166470 | A1 * | 7/2010 | Yokoyama | 399/330 |
| 2010/0322654 | A1 * | 12/2010 | Kikuchi et al. | 399/67 |
| 2010/0322655 | A1 * | 12/2010 | Kikuchi et al. | 399/67 |
| 2010/0322658 | A1 * | 12/2010 | Kikuchi et al. | 399/69 |
| 2010/0322681 | A1 * | 12/2010 | Kikuchi et al. | 399/323 |
| 2010/0322684 | A1 * | 12/2010 | Kikuchi et al. | 399/331 |
| 2011/0070006 | A1 * | 3/2011 | Sone et al. | 399/333 |
| 2011/0076043 | A1 * | 3/2011 | Kikuchi et al. | 399/69 |
| 2011/0085832 | A1 * | 4/2011 | Hasegawa et al. | 399/329 |
| 2011/0135358 | A1 * | 6/2011 | Kikuchi et al. | 399/329 |
| 2011/0135359 | A1 * | 6/2011 | Kikuchi et al. | 399/333 |
| 2011/0217094 | A1 * | 9/2011 | Hasegawa | 399/329 |
| 2011/0217096 | A1 * | 9/2011 | Kikuchi et al. | 399/329 |
| 2011/0262194 | A1 * | 10/2011 | Sone et al. | 399/329 |
| 2011/0311256 | A1 * | 12/2011 | Furuyama | 399/70 |
| 2012/0207502 | A1 * | 8/2012 | Seo | 399/69 |
| 2012/0230743 | A1 * | 9/2012 | Matsusaka et al. | 399/335 |
| 2012/0308278 | A1 * | 12/2012 | Kikuchi et al. | 399/329 |
| 2013/0051877 | A1 * | 2/2013 | Sone et al. | 399/329 |

* cited by examiner

| TYPE OF HYDRAULIC FLUID | CONTACT TEMPERATURE | SEPARATION TEMPERATURE |
|---|---|---|
| PURE WATER | 210°C | 160°C |
| ETHANOL | 190°C | 155°C |
| METHANOL | 190°C | 155°C |
| ACETONE | 170°C | 150°C |

AUXILIARY HEAT GENERATING MEMBER IS PROVIDED (IN CONTACT WITH OR SEPARATED FROM FIXING BELT)

FUSER, IMAGE FORMING APPARATUS, AND IMAGE FORMING METHOD

CROSS-REFERENCE TO RELATED APPLICATION

This application is based upon and claims the benefit of priority from Provisional U.S. Applications 61/528,049 filed on Aug. 26, 2011, 61/563,006 filed on Nov. 22, 2011, and 61/563,008 filed on Nov. 22, 2011, the entire contents of which are incorporated herein by reference.

FIELD

Embodiments described herein relate generally to a fuser, an image forming apparatus and an image forming method.

BACKGROUND

A fuser in the past includes, near a fixing belt, a heating member for heating the fixing belt and includes, on the inside of the fixing belt, an auxiliary heat generating member that indirectly heats the fixing belt. When a sheet having a size smaller than the width of the fixing belt passes the center of the fixing belt having a predetermined temperature, the temperature of only the center drops. A heating member heats the entire fixing belt in order to raise the temperature of the center where the temperature drops. Therefore, when the temperature of the center reaches the predetermined temperature, the ends of the fixing belt where the sheet does not pass are excessively heated. The temperature of the ends rises to be higher than the temperature of the center. As a result, in the fixing belt, temperature unevenness occurs in the longitudinal direction of the fixing belt.

DETAILED DESCRIPTION

Certain embodiments provide a fuser including a cylindrical fixing belt, a heating member, an auxiliary heat generating member, a plurality of heat pipes, a pressurizing pad, and a pressurizing roller. The heating member heats the fixing belt. The auxiliary heat generating member auxiliary heats the fixing belt. The plural heat pipes are sparsely arranged in the center in the longitudinal direction of the auxiliary heat generating member and more densely arranged at the ends in the longitudinal direction of the auxiliary heat generating member than in the center. The pressurizing pad is arranged on the inside of the fixing belt. The pressurizing roller is arranged in contact with the outer circumference of the fixing belt. The pressurizing roller presses the fixing belt against the pressurizing pad.

Fusers, image forming apparatuses, and image forming methods according to embodiments are explained below.

First Embodiment

Figure 1:
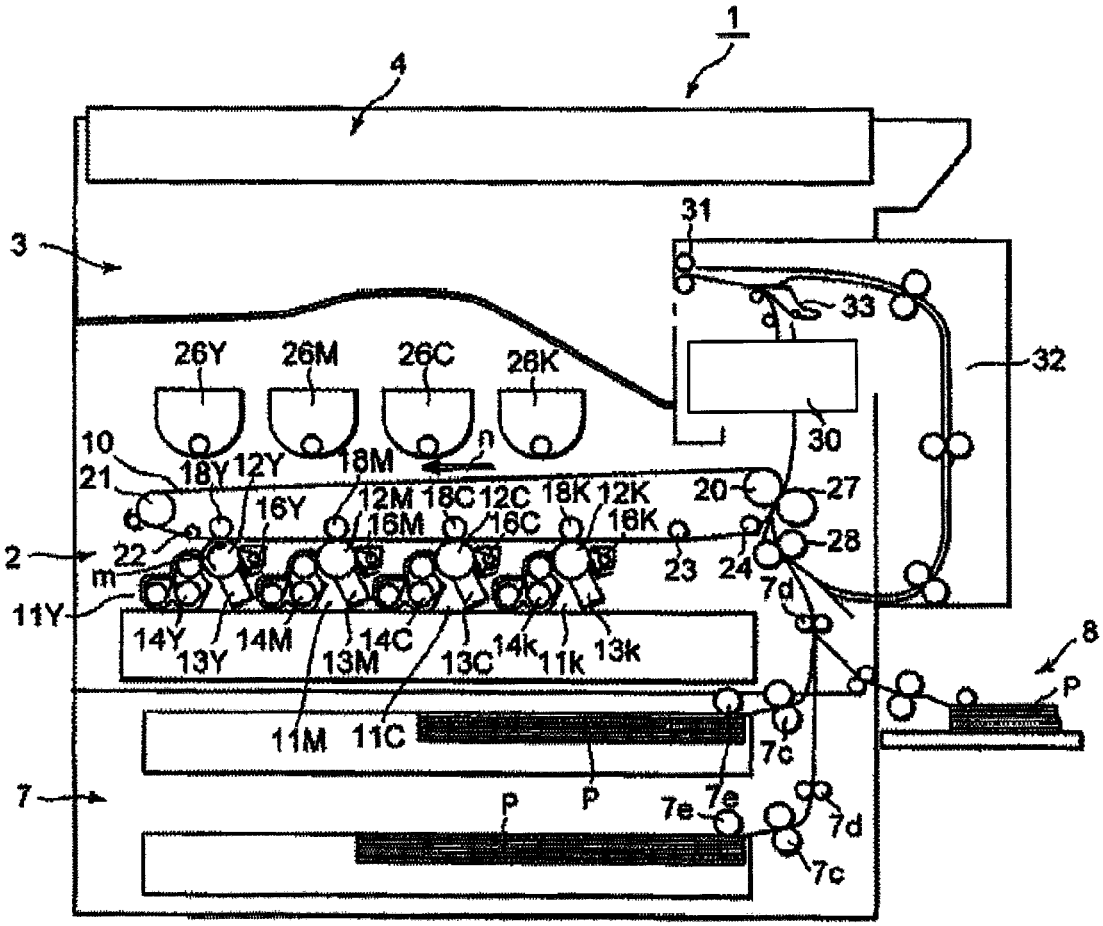
FIG. 1 is a schematic explanatory diagram of an image forming apparatus according to a first embodiment.

FIG. 1 is a schematic explanatory diagram of an image forming apparatus according to a first embodiment. An image forming apparatus 1 includes a scanner section 4 that reads a document image, a printer section 2 that forms a toner image, a paper feeding device 7 and a manual paper feeding device 8 that feed sheets P, which are recording media, to the printer section 2, and a paper discharge section 3 that accumulates the sheets P discharged from the printer section 2.

The printer section 2 forms a toner image on the sheet P on the basis of electronic data formed by the scanner section 4. The printer section 2 includes four sets of image forming stations 11Y, 11M, 11C, and 11K for Y (yellow), M (magenta), C (cyan), and K (black) arranged in parallel along the lower side of an intermediate transfer belt 10 explained below.

The image forming station 11Y includes a photoconductive drum 12Y as an image bearing member. The image forming station 11Y forms a toner image of Y (yellow) on the photoconductive drum 12Y.

The photoconductive drum 12Y rotates in an arrow m direction. Around the photoconductive drum 12Y, an electrifying charger 13Y, a developing device 14Y, and a photoconductive member cleaner 16Y are arranged along a rotting direction of the photoconductive drum 12Y.

The image forming stations 11M, 11C, and 11K include components same as those of the image forming station 11Y. Therefore, the same reference numerals and signs are used for the components except signs representing the colors and explanation of the components is omitted.

A toner cartridge 26Y that supplies a toner of Y (yellow) to the photoconductive drum 12Y is provided above the image forming station 11M via the intermediate transfer belt 10 explained below. Toner cartridges 26M, 26C, and 26K are provided in the same manner.

The intermediate transfer belt 10 is arranged with the outer circumferential surface thereof set in contact with the photoconductive drums 12Y, 12M, 12C, and 12K. The intermediate transfer belt 10 is stretched and suspended by a backup roller 20, a driven roller 21, and first to third tension rollers 22 to 24. The intermediate transfer belt 10 is rotated in an arrow n direction according to the rotation of the backup roller 20.

A primary transfer roller 18Y is provided in a position opposed to the photoconductive drum 12Y across the intermediate transfer belt 10. Primary transfer rollers 18M, 18C, and 18K are provided in the same manner.

A secondary transfer roller 27 is arranged in a position opposed to the backup roller 20 across the intermediate transfer belt 10.

Pickup rollers 7*e*, separating rollers 7*c*, conveying rollers 7*d*, and a registration roller pair 28 are provided between the paper feeding device 7 and the secondary transfer roller 27.

A fuser 30 is provided downstream of the secondary transfer roller 27 along a conveying direction of the sheet P. The fuser 30 fixes a toner image, which is secondarily transferred onto the sheet P, on the sheet P and forms a copy image on the sheet P.

A gate 33 that diverts the sheet P in the direction of a paper discharge roller 31 or the direction of a re-conveying unit 32 is provided downstream of the fuser 30.

When the image forming apparatus 1 explained above is in a monochrome mode, the image forming apparatus 1 rotates only the photoconductive drum 12K for black in the arrow m direction to form a monochrome copy image. When the image forming apparatus 1 is in a color mode, the image forming apparatus 1 rotates all the photoconductive drums 12Y, 12M, 12C, and 12K to form a color copy image.

Figure 2:
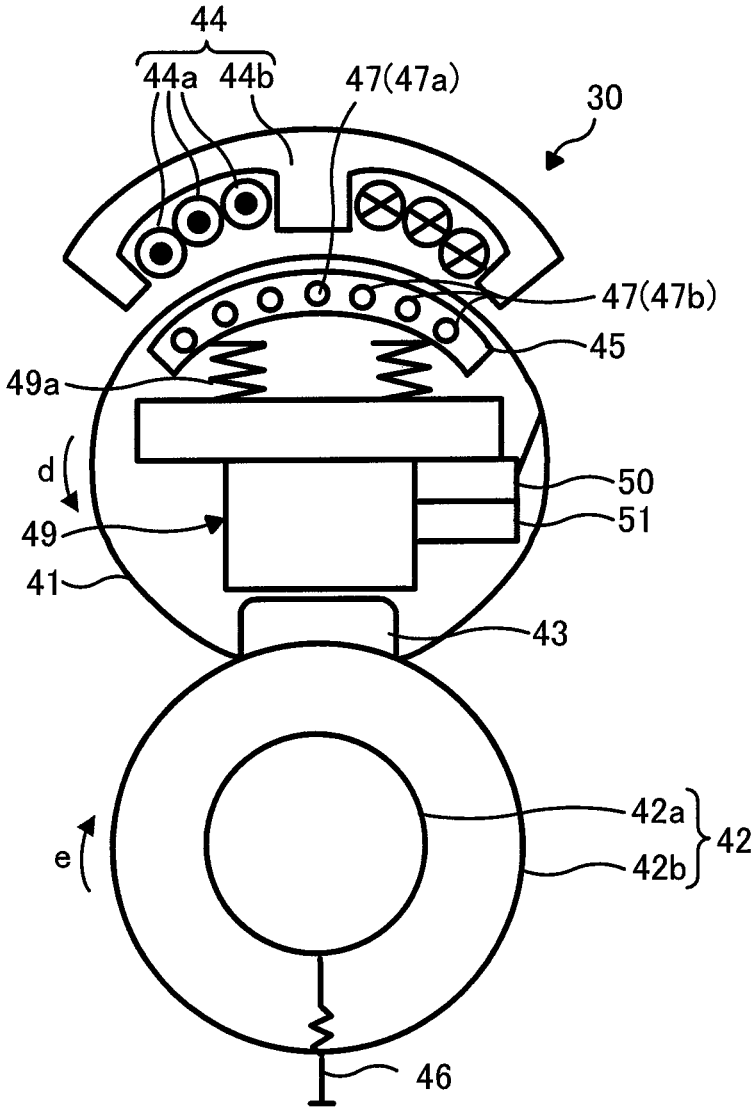
FIG. 2 is a schematic sectional view of a fuser included in the image forming apparatus.

FIG. 2 is a schematic sectional view of the fuser 30 included in the image forming apparatus 1 according to the first embodiment. As shown in FIG. 2, the fuser 30 includes a fixing belt 41, a pressurizing roller 42, a pressurizing member 43, a heating member 44, and an auxiliary heat generating member 45.

The fixing belt 41 is, for example, a cylindrical endless belt made of metal. The fixing belt 41 has a multilayer structure including a heat generating layer, which is a conductive layer. In the fixing belt 41, for example, a heat generating layer, an elastic layer, and a release layer are laminated in order from the inner circumference side to the outer circumference side. The heat generating layer is a layer in which an eddy-current is generated by a magnetic flux generated from an electromagnetic induction heating (IH) section 44, which is the heating member 44. The heat generating layer is heated by Joule heat of the eddy-current generated in the heat generating layer. The heat generating layer is formed by a metal layer including SUS or Cu. The release layer is a layer for suppressing a toner, which forms a toner image on the sheet P, from adhering to the fixing belt 41.

The fixing belt 41 is reduced in thickness and reduced in heat capacity in order to reduce time necessary for warming-up (time necessary until the temperature of the fixing belt 41 reaches a predetermined fixing temperature). In other words, the respective thicknesses of the heat generating layer, the elastic layer, and the release layer are reduced in order to reduce the time necessary for warming-up.

The fixing belt 41 rotates in an arrow d direction following the pressurizing roller 42.

In this embodiment, a belt includes a film-like belt. Therefore, the fixing belt 41 is not limited to the configuration explained above and may be, for example, a belt formed in a film shape.

The pressurizing roller 42 is a roller including an elastic layer 42*b* and including, on the surface, a release layer (not shown) made of fluorocarbon resin.

The pressurizing roller 42 is arranged in a position in contact with a part of the outer circumference of the fixing belt 41 such that the longitudinal direction (a direction orthogonal to a rotating direction of the fixing belt 41) of the pressurizing roller 42 is parallel to the longitudinal direction of the fixing belt 41. A gear (not shown) provided at an end of a cored bar 42*a* is rotated by a motor (not shown), whereby the pressurizing roller 42 rotates in an arrow e direction.

The pressurizing roller 42 includes a pressing member 46 such as a spring. The pressing member 46 presses the pressurizing roller 42 against a pressurizing pad 43 explained below.

The pressurizing member 43 is the pressurizing pad 43 including a release layer on the surface of an elastic body. The pressurizing pad 43 is arranged on the inside of the fixing belt 41 such that the longitudinal direction of the pressurizing pad 43 is parallel to the longitudinal direction of the fixing belt 41.

The pressurizing roller 42 presses the fixing belt 41 against the pressurizing pad 43, whereby a nip portion having nip width necessary for satisfying desired fixing performance is formed between the fixing belt 41 and the pressurizing roller 42.

The heating member 44 is the electromagnetic induction heating (IH) section 44 having an arcuate shape along a part of the outer circumferential surface of the fixing belt 41. The heating member 44 heats the fixing belt 41. The IH section 44 includes an electromagnetic induction heating (IH) coil 44*a* and a ferrite core 44*b*.

The IH coil 44*a* generates an eddy-current, which is an induced current, in the heat generating layer of the fixing belt 41. The fixing belt 41 is heated by Joule heat generated by the eddy-current generated in the heat generating layer of the fixing belt 41.

The ferrite core 44*b* blocks a magnetic flux generated in the outward direction of the fuser 30 by the IH coil 44*a* and increases the density of a magnetic flux generated in the inward direction of the fuser 30 (a direction in which the fixing belt 41 is arranged) by the IH coil 44*a*.

The IH coil 44*a* generates an eddy-current, which is an induced current, in an auxiliary heat generating layer 45*a* (FIG. 3) of the auxiliary heat generating member 45 explained below as well. The fixing belt 41 is heated as well by Joule heat generated by the eddy-current generated in the auxiliary heat generating layer 45*a* of the auxiliary heat generating member 45.

The IH section 44 is arranged in a position separated from the outer circumference of the fixing belt 41, which is a position opposed to the pressurizing roller 42, such that the longitudinal direction of the IH section 44 is parallel to the longitudinal direction of the fixing belt 41. The heating member 44 does not always need to be the IH section 44 and can be a heating lamp.

The auxiliary heat generating member 45 supports a raise in the temperature of the fixing belt 41. Specifically, the auxiliary heat generating member 45 indirectly raises the temperature of the fixing belt 41 on the basis of a magnetic flux generated from the IH section 44.

The auxiliary heat generating member 45 is formed in an arcuate shape along the inner circumferential surface of the fixing belt 41. The auxiliary heat generating member 45 is arranged in a position opposed to the IH section 44 via the fixing belt 41, which is a position near the inner circumferential surface of the fixing belt 41 (e.g., a position about 1 mm away from the inner circumferential surface of the fixing belt 41), such that the longitudinal direction of the auxiliary heat generating member 45 is parallel to the longitudinal direction of the fixing belt 41.

The auxiliary heat generating member 45 may be arranged in a position in contact with the inner circumferential surface of the fixing belt 41. In the following explanation, when the auxiliary heat generating member 45 is expressed as being in contact with the inner circumferential surface of the fixing belt 41, it is assume that the auxiliary heat generating member 45 is arranged in one of the position near the inner circumferential surface of the fixing belt 41 and the position in contact with the inner circumferential surface of the fixing belt 41.

Figure 3:
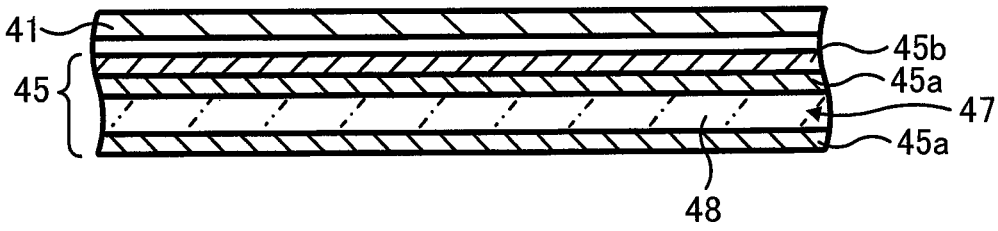
FIG. 3 is a diagram of the structure of an auxiliary heat generating member and is a sectional view of a part of the auxiliary heat generating member taken along the longitudinal direction of the auxiliary heat generating member.

FIG. 3 is a diagram of the structure of the auxiliary heat generating member 45 and is a sectional view of a part of the auxiliary heat generating member 45 taken along the longitudinal direction of the auxiliary heat generating member 45. As shown in FIG. 3, the auxiliary heat generating member 45 includes the auxiliary heat generating layer 45*a* and a release layer 45*b*.

The auxiliary heat generating layer 45*a* is a layer in which an eddy-current is generated on the basis of a magnetic flux generated by an electric current flowing to the IH coil 44*a*. The auxiliary heat generating member 45 is heated by Joule heat generated by the eddy-current generated in the auxiliary heat generating layer 45*a*. The auxiliary heat generating layer 45*a* is made of, for example, magnetic metal such as iron (Fe), nickel (Ni), copper (Cu), stainless steel (SUS), or ferrite or aluminum.

When iron (Fe) or stainless steel (SUS) is adopted as the material of the auxiliary heat generating layer 45*a*, it is possible to reduce the thickness of the auxiliary heat generating layer 45*a* while keeping desired mechanical strength. When iron (Fe) is adopted as the material of the auxiliary heat generating layer 45*a*, it is possible to inexpensively manufacture the auxiliary heat generating layer 45*a* compared with the auxiliary heat generating layer 45*a* manufactured when stainless steel (SUS) is adopted as the material of the auxiliary heat generating layer 45*a*.

Aluminum has high thermal conductivity compared with iron (Fe) and stainless steel (SUS). Therefore, it is more suitable to adopt aluminum as the material of the auxiliary heat generating layer 45*a*.

The release layer 45*b* is provided on the surface of the auxiliary heat generating layer 45*a*.

In the auxiliary heat generating member 45, a magnetism blocking layer 47 is provided in the auxiliary heat generating layer 45*a*. The magnetism blocking layer 47 is, for example, heat pipes 47. The heat pipes 47 are cylindrical metal bodies made of a material having high thermal conductivity such as aluminum or copper. The inner diameter of the heat pipes 47 is, for example, about 1.5 mm.

The heat pipes 47 are fixed to the auxiliary heat generating layer 45*a*. The heat pipes 47 may be integrally molded with the auxiliary heat generating layer 45*a*.

The heat pipes 47 include hydraulic fluid 48 on the inside. The hydraulic fluid 48 is means for transporting heat. The hydraulic fluid 48 include fluid such as pure water, ethanol, methanol, acetone, chlorofluorohydrocarbon, or the like or a mixture of these fluids.

When the heat distribution in the longitudinal direction of the fixing belt 41 becomes non-uniform, the hydraulic fluid 48 in the heat pipes 47 transports heat in a high-temperature portion to a low-temperature portion. Therefore, when the heat distribution in the longitudinal direction of the fixing belt 41 becomes non-uniform, the heat pipes 47 can make the heat distribution in the longitudinal direction of the fixing belt 41 uniform.

Figure 4:
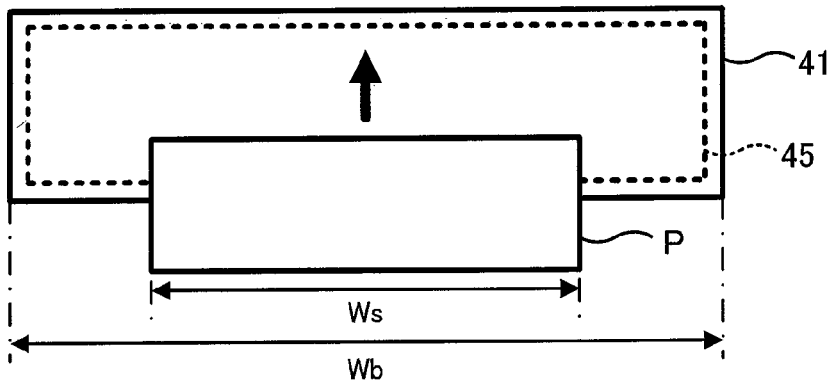
FIG. 4 is a schematic diagram for explaining a positional relation between a fixing belt and the auxiliary heat generating member and a sheet P supplied to a fuser.

FIG. 4 is a schematic diagram for explaining a positional relation between the fixing belt 41 and the auxiliary heat generating member 45 and the sheet P supplied to the fuser 30. As shown in FIG. 4, it is assumed that the sheet P having width Ws smaller than width Wb of the fixing belt 41 passes on the center of the fixing belt 41. Every time the sheet P passes on the center of the fixing belt 41, the sheet P removes heat from the center of the fixing belt 41, the temperature of the center of the fixing belt 41 drops. Then, the heating member IH section 44 (FIG. 2) heats the entire fixing belt 41 in order to raise the dropped temperature to a desired temperature (the fixing temperature). However, when the sheet P passes on the fixing belt 41, the temperature of the ends of the fixing belt 41 where the sheet P does not pass does not drop. Therefore, the temperature of the ends of the fixing belt 41 rises more than necessary according to the heating of the fixing belt 41. As a result, the temperatures become non-uniform between the center and the ends of the fixing belt 41. At this point, the heat pipes 47 (FIG. 4) move heat from the ends of the fixing belt 41 where the temperature is high to the center of the fixing belt 41 where the temperature is low. Therefore, when the heat of the fixing belt 41 becomes non-uniform, the heat pipes 47 can make the heat of the fixing belt 41 uniform.

Figure 5A:
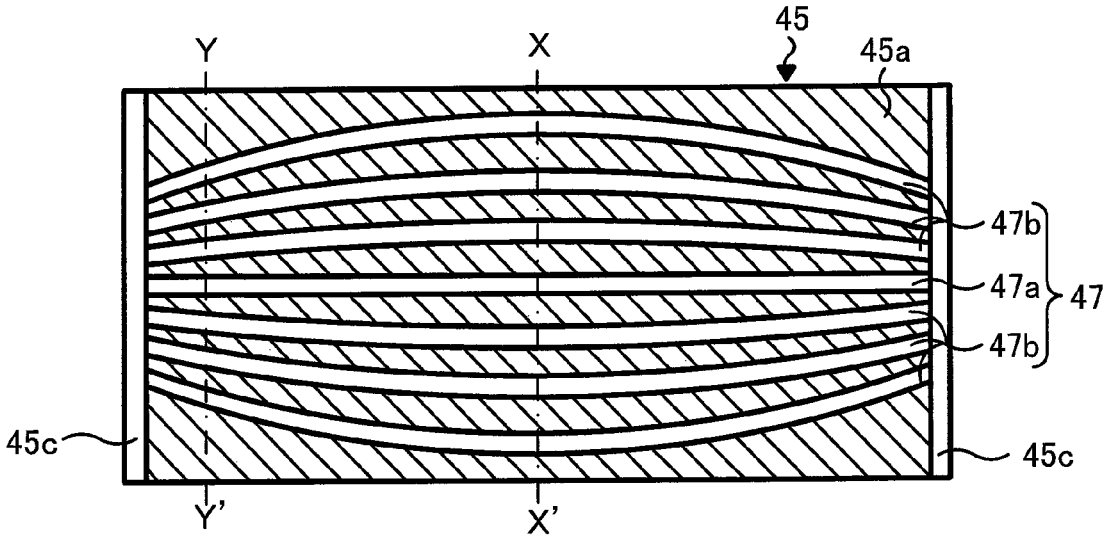
FIG. 5A is a schematic plan view of the auxiliary heat generating member for explaining a relation between the auxiliary heat generating member and heat pipes.

FIG. 5A is a schematic plan view of the auxiliary heat generating member 45 for explaining a relation between the auxiliary heat generating member 45 and the heat pipes 47. As shown in FIG. 5A, the auxiliary heat generating member 45 includes plural heat pipes 47 in the auxiliary heat generating layer 45*a*. The heat pipes 47 are sealed by ends 45*c* of the auxiliary heat generating member 45.

One of the plural heat pipes 47 is a linear heat pipe 47*a*. The heat pipe 47*a* is provided substantially in the center of the auxiliary heat generating member 45 along the longitudinal direction of the auxiliary heat generating member 45. The other heat pipes 47 are respectively curved heat pipes 47*b* curved in the center. Each of the heat pipes 47*b* is provided on one of both sides of the linear heat pipe 47*a* along the longitudinal direction of the auxiliary heat generating member 45. Each of the curved heat pipes 47*b* is curved toward the outer side of the auxiliary heat generating member 45 in a direction perpendicular to the longitudinal direction of the auxiliary heat generating member 45. The curvature of the curved heat pipes 47*b* gradually increases further away from the linear heat pipe 47*a*.

Figure 6:
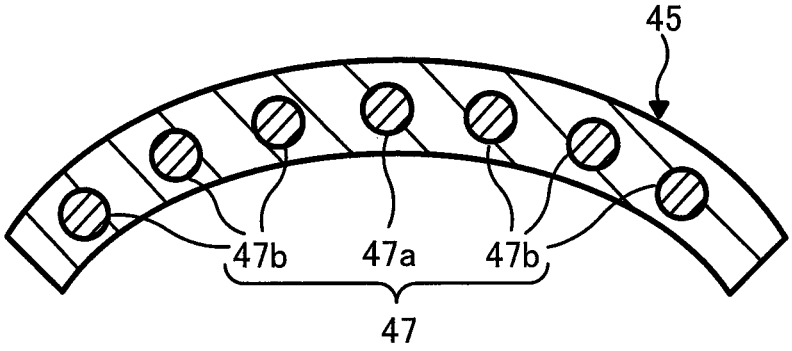
FIG. 6 is a sectional view of the auxiliary heat generating member taken along an alternate long and short dash line X-X' shown in FIG. 5A.
Figure 7:
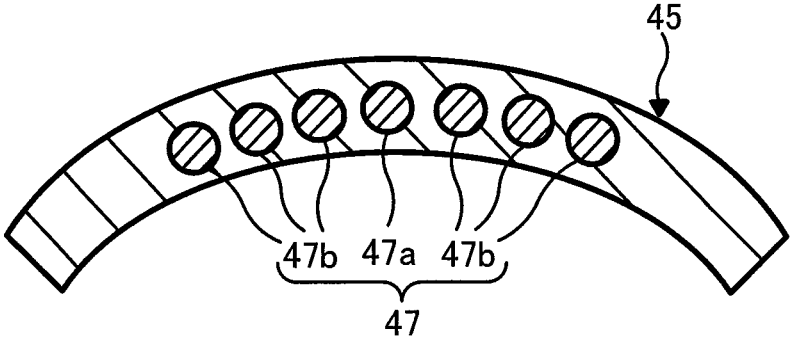
FIG. 7 is a sectional view of the auxiliary heat generating member taken along an alternate long and short dash line Y-Y' shown in FIG. 5A.

FIG. 6 is a sectional view of the auxiliary heat generating member 45 taken along an alternate long and short dash line X-X' shown in FIG. 5A. FIG. 7 is a sectional view of the auxiliary heat generating member 45 taken along an alternate long and short dash line Y-Y' shown in FIG. 5A.

As a result of arranging the plural heat pipes 47 as shown in FIG. 5A, the plural heat pipes 47 are arranged as shown in FIGS. 6 and 7. Specifically, compared with an auxiliary heat generating member in the past in which plural linear heat pipes provided in a number same as the number of the heat pipes 47 included in the auxiliary heat generating member 45 of the fuser 30 according to this embodiment are arranged in parallel to one another and at an equal interval one another, the plural heat pipes 47 are sparsely arranged in the center of the auxiliary heat generating member 45 (FIG. 6) and densely arranged at the ends of the auxiliary heat generating member 45 (FIG. 7). Therefore, in the auxiliary heat generating member 45, compared with the auxiliary heat generating member in the past, the heat capacity in the center is large. In the auxiliary heat generating member 45, compared with the auxiliary heat generating member in the past, the heat transport efficiency at the ends is high.

The heat pipes 47 may be bar-like or planar metal made of a material having high thermal conductivity such as aluminum or copper. Such heat pipes made of the bar-like metal may be provided on the surface of the auxiliary heat generating layer 45*a* as shown in FIG. 5A. When the heat pipes made of the bar-like or planar metal is adopted, the heat pipes may be fixed to the auxiliary heat generating layer 45*a* by being metal-joined or screwed to the auxiliary heat generating layer 45*a*, may be integrally formed with the auxiliary heat generating layer 45*a*, or may be fit in grooves provided on the surface of the auxiliary heat generating layer 45*a*.

Figure 5B:
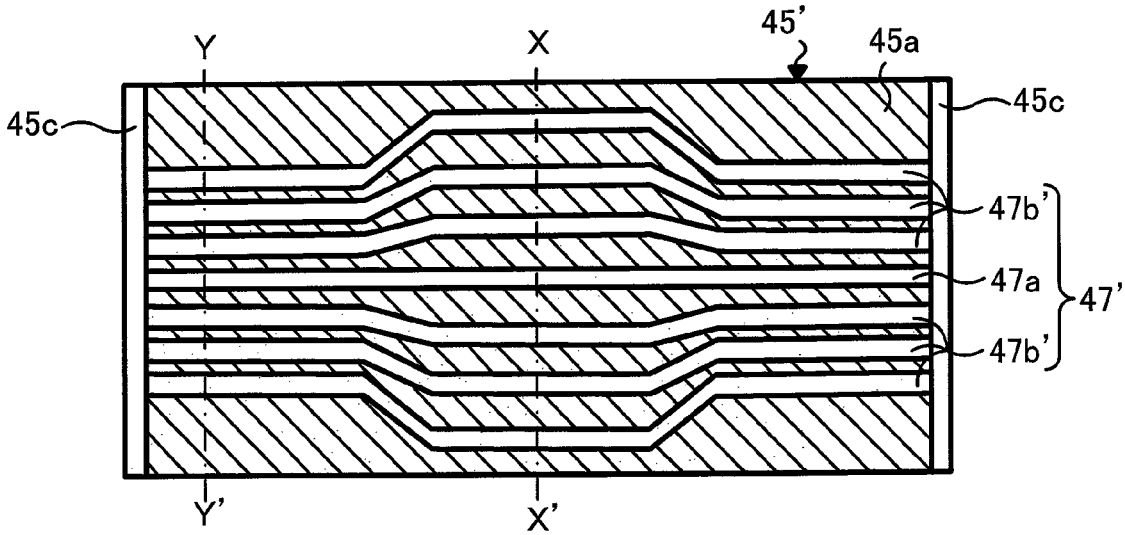
FIG. 5B is a schematic plan view of another auxiliary heat generating member for explaining a relation between an auxiliary heat generating member and heat pipes.

In FIG. 5A, the heat pipes 47*b* are arranged in an arcuate shape. However, the shape of the heat pipes 47*b* is not limited to the arcuate shape. For example, as in an auxiliary heat generating member 45' shown in FIG. 5B, heat pipes 47*b*' among the heat pipes 47' may be arranged in a mountain shape. In other words, both ends of the linear shape of the heat pipes 47*b*' are arranged in parallel to the alternate long and short dash line X-X'. Similarly, top portions in the centers of the mountain shape of the heat pipes 47*b*' are arranged in parallel to the alternate long and short dash line X-X'. However, the top portions are arranged at an interval wider than an interval of both the ends. Bases of the centers of the heat pipes 47*b*' are connected to the ends. The heat pipes 47*b*' may be arranged in such a shape.

Referring back to FIG. 2, the auxiliary heat generating member 45 including the plural heat pipes 47 explained above is supported by a frame 49 including elastic bodies 49*a* such as springs, which is provided on the inside of the fixing belt 41, in a state in which the auxiliary heat generating member 45 is in contact with the inner circumferential surface of the fixing belt 41.

A temperature sensor 50 that detects the temperature of the fixing belt 41 is arranged on the inside of the fixing belt 41. The temperature sensor 50 is, for example, a contact-type thermistor arranged in contact with the inner circumferential surface of the fixing belt 41.

Further, on the inside of the fixing belt 41, a thermostat 51, which is a safety device for preventing the temperature of the fixing belt 41 from rising to be equal to or higher than a predetermined temperature, is provided. When the temperature of the fixing belt 41 rises to be equal to or higher than the predetermined temperature, the thermostat 51 physically shuts off heating treatment of the fixing belt 41 by the IH section 44. Further, when the temperature of the fixing belt 41 rises to be equal to or higher than the predetermined temperature, the thermostat 51 physically shuts off the supply of an electric current to the IH coil 44*a* of the IH section 44.

The fuser 30 operates as explained below. When a power supply for the image forming apparatus 1 is turned on and the temperature of the fixing belt 41 rises to the predetermined temperature (e.g., the fixing temperature), the sheet P having a toner image formed thereon is conveyed to the fuser 30. The sheet P reaches the nip portion between the fixing belt 41 and the pressurizing roller 42. While the toner image is heated and pressed in the nip portion, the sheet P is conveyed to the downstream side of the fixing belt 41. The toner image is fixed on the sheet P. The sheet P having the toner image fixed thereon, i.e., the sheet P having a copy image formed thereon is discharged from the fuser 30.

In the fuser 30 and the image forming apparatus 1 according to this embodiment explained above, the auxiliary heat generating member 45 included in the fuser 30 includes the plural heat pipes 47 sparsely arranged in the center of the auxiliary heat generating member 45 and densely arranged at the ends of the auxiliary heat generating member 45. Therefore, it is possible to suppress the heat distribution in the longitudinal direction of the fixing belt 41 from becoming non-uniform and, when the heat distribution becomes non-uniform, quickly make the heat distribution uniform.

In other words, since the plural heat pipes 47 are sparsely arranged in the center of the auxiliary heat generating member 45, the heat capacity in the center of the auxiliary heat generating member 45 is large. Therefore, an apparent heat capacity in the center of the fixing belt 41 in contact with the center of the auxiliary heat generating member 45 is also large. As a result, for example, when the sheet P having the width Ws smaller than the width Wb of the fixing belt 41 passes on the center of the fixing belt 41 as shown in FIG. 4, it is possible to suppress a heat quantity removed by the sheet P and suppress a temperature drop amount in the center of the fixing belt 41 involved in the passage of the sheet P. Therefore, it is possible to suppress the heat distribution in the longitudinal direction of the fixing belt 41 from becoming non-uniform.

When the temperature of the center of the fixing belt 41 drops because, for example, the sheet P having the width Ws smaller than the width Wb of the fixing belt 41 and large thickness passes on the fixing belt 41 or a large number of the sheets P having the width Ws smaller than the width Wb of the fixing belt 41 pass on the fixing belt 41, the entire fixing belt 41 is heated to reset the temperature of the center of the fixing belt 41 to the predetermined temperature (the fixing temperature). Since the sheet P does not pass on the ends of the fixing belt 41, the temperature of the ends of the fixing belt 41 rises to be higher than the predetermined temperature (the fixing temperature) according to the heating of the entire fixing belt 41. As a result, the heat distribution in the longitudinal direction of the fixing belt 41 becomes non-uniform. However, the plural heat pipes 47 are densely arranged at the ends of the auxiliary heat generating member 45 and the heat transport efficiency at the ends of the auxiliary heat generating member 45 is high. Therefore, the auxiliary heat generating member 45 can quickly transport the heat of the ends of the fixing belt 41 to the center of the fixing belt 41 where the temperature is low. Therefore, when the temperature distribution in the longitudinal direction becomes non-uniform, it is possible to quickly make the heat distribution uniform.

Further, with the fuser 30 and the image forming apparatus 1 according to this embodiment explained above, since a heat quantity removed from the center of the fixing belt 41 by the sheet P is small, a temperature drop amount in the center of the fixing belt 41 is also small. Therefore, a heat quantity supplied to the fixing belt 41 by the IH section 44 in order to reset the temperature of the center of the fixing belt 41 to the predetermined temperature (the fixing temperature) may also be small. As a result, it is also possible to suppress total electric energy necessary in the fuser 30 and the image forming apparatus 1 including the fuser 30.

Second Embodiment

Figure 8:
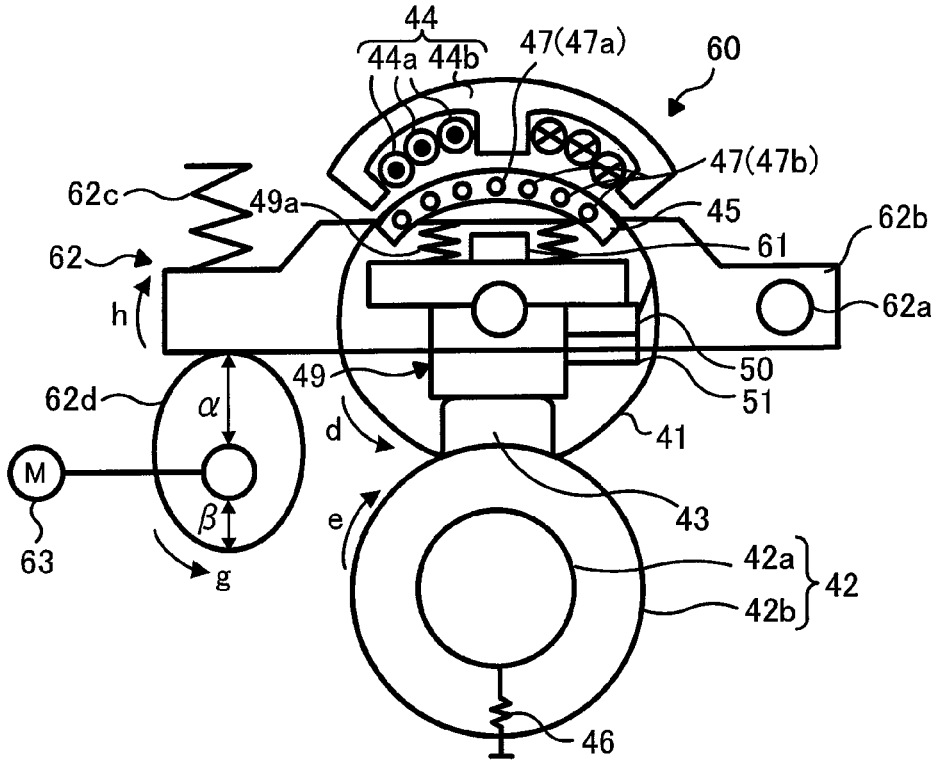
FIG. 8 is a schematic diagram of a fuser according to a second embodiment and is a sectional view of the fuser in which an auxiliary heat generating member is in contact with a fixing belt.
Figure 9:
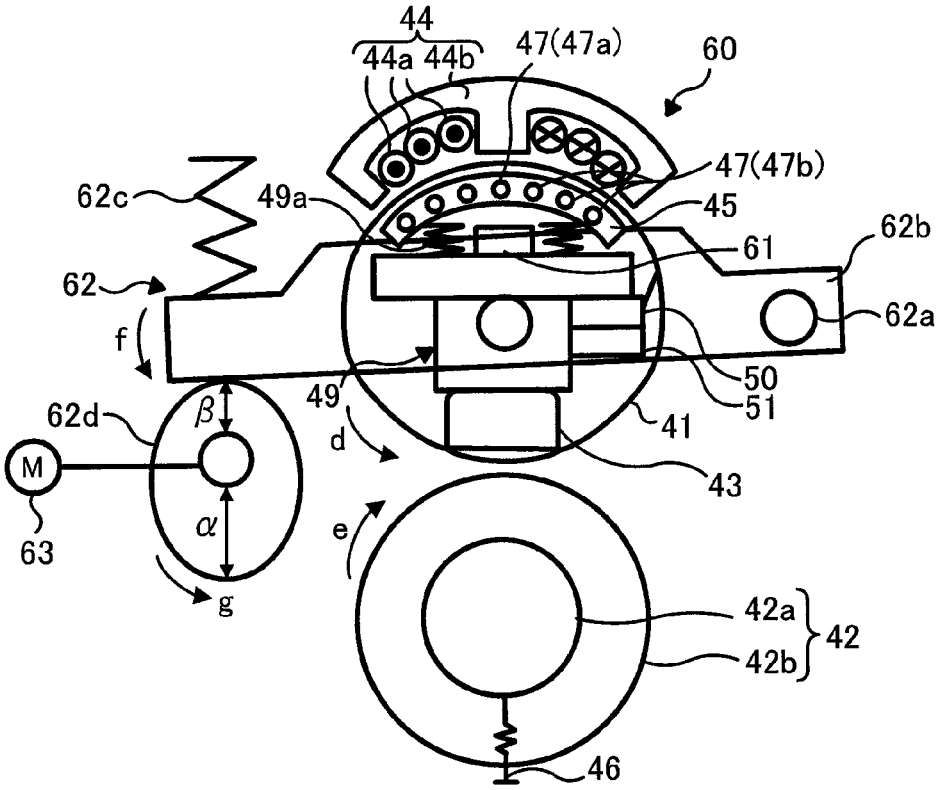
FIG. 9 is a schematic sectional view of the fuser and is a sectional view of the fuser in which the auxiliary heat generating member is separated from the fixing belt.

FIGS. 8 and 9 are schematic sectional views of a fuser according to a second embodiment. The fuser 60 according to the second embodiment is applied instead of the fuser 30 in the image forming apparatus 1 shown in FIG. 1. Therefore, explanation of an image forming apparatus according to the second embodiment including the fuser 60 according to the second embodiment is omitted.

The fuser 60 shown in FIGS. 8 and 9 is different from the fuser 30 shown in FIG. 2 in that the fuser 60 includes a temperature sensor for auxiliary heat generating member 61 for detecting the temperature of the hydraulic fluid 48 of the heat pipes 47 provided on the inside of the auxiliary heat generating member 45 and includes a moving section 62, which is means for moving the auxiliary heat generating member 45.

The other components are the same as those of the fuser 30 shown in FIG. 2. Therefore, in explanation of the fuser 60 according to the second embodiment, explanation concerning the components same as those of the fuser 30 shown in FIG. 2 is omitted. In the fuser 60 shown in FIGS. 8 and 9, the components same as those of the fuser 30 shown in FIG. 2 are denoted by the same reference numerals and signs.

The temperature sensor for auxiliary heat generating member 61 is, for example, a temperature of a non-contact type. The temperature sensor for auxiliary heat generating member 61 is provided, for example, on the frame 49 in the fixing belt 41. However, the temperature sensor for auxiliary heat generating member 61 may be arranged in other places as long as the places are in positions where the temperature of the hydraulic fluid 48 in the heat pipes 47 or the temperature of the surface of the heat pipes 47 can be detected.

The moving section 62 moves the auxiliary heat generating member 45 between a position where the auxiliary heat generating member 45 comes into contact with the inner circumferential surface of the fixing belt 41 (FIG. 8) and a position where the auxiliary heat generating member 45 separates from the inner circumferential surface of the fixing belt 41 (FIG. 9).

The moving section 62 includes an arm 62*b* that pivots about a shaft 62*a* while supporting the frame 49 and means for moving the arm 62*b*. The means for moving the arm 62*b* is an elastic body 62*c* such as a spring and a cam 62*d*.

The elastic body 62*c* gives a pivoting force in an arrow f direction in the figure to the arm 62*b*. The cam 62*d* rotates in an arrow g direction in the figure about an eccentric position and gives a pivoting force in an arrow h direction in the figure, which is against the pivoting force by the elastic member 62*c*, to the arm 62*b*.

As shown in FIG. 8, the cam 62*d* is rotated by a motor for moving section 63 to bring a long side a of the cam 62*d* into contact with the arm 62*b*. At this point, the cam 62*d* gives the pivoting force in the arrow h direction in the figure to the arm 62*b*. The arm 62*b* pivots in the arrow h direction with the pivoting force given by the cam 62*d*. The frame 49 supported by the arm 62*b* moves in the upward direction in the figure. Consequently, the auxiliary heat generating member 45 supported by the frame 49 comes into contact with the inner circumferential surface of the fixing belt 41.

As shown in FIG. 9, the cam 62*d* is rotated by the motor for moving section 63 to bring a short side β of the cam 62*d* into contact with the arm 62*b*. At this point, the elastic body 62*c* gives the pivoting force in the arrow f direction in the figure to the arm 62*b*. The arm 62*b* pivots in the arrow f direction with the pivoting force given by the elastic body 62*c*. The frame 49 supported by the arm 62*b* moves in the downward direction in the figure. Consequently, the auxiliary heat generating member 45 supported by the frame 49 separates from the inner circumferential surface of the fixing belt 41.

The fuser 60 basically operates in the same manner as the fuser 30 according to the first embodiment. When a power supply for an image forming apparatus including the fuser 60 is turned on and the temperature of the fixing belt 41 reaches a predetermined temperature (e.g., a fixing temperature), the sheet P having a toner image formed thereon is conveyed to the fuser 60. The sheet P reaches the nip portion between the fixing belt 41 and the pressurizing roller 42. While the toner image is heated and pressed in the nip portion, the sheet P is conveyed to the downstream side of the fixing belt 41 and the toner image is fixed on the sheet P. The sheet P having the toner image fixed thereon, i.e., the sheet P having a copy image formed thereon is discharged from the fuser 60.

Figure 10:
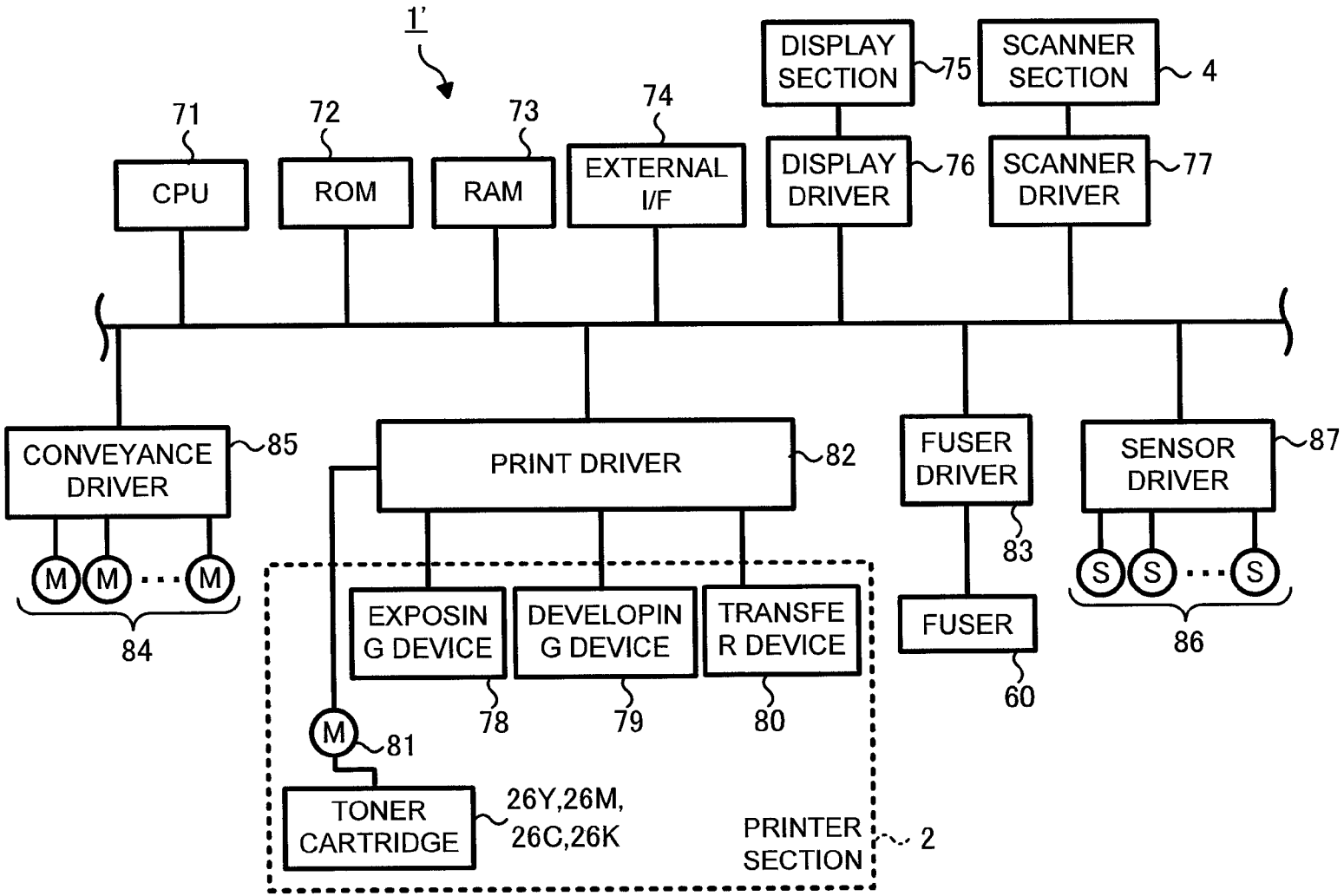
FIG. 10 is a schematic block diagram for explaining an electrical connection relation of an image forming apparatus including the fuser.

FIG. 10 is a schematic block diagram for explaining an electrical connection relation of an image forming apparatus 1' including the fuser 60 according to the second embodiment. As shown in FIG. 10, the image forming apparatus 1' includes a CPU 71, which is a controller that manages overall control, a ROM 72 in which a control program and the like are stored, a RAM 73 that temporarily stores data, and an external interface 74 for exchanging various data between various devices, which can communicate with the image forming apparatus 1', and the image forming apparatus 1'. Each of the ROM 72, the RAM 73, and the external interface 74 is connected to the CPU 71.

In the ROM 72, a control program for causing the image forming apparatus 1' to operate as designated is stored. In the ROM 72, reference data serving as a reference for moving the auxiliary heat generating member 45 to a position where the auxiliary heat generating member 45 comes into contact with the fixing belt 41 or a position where the auxiliary heat generating member 45 separates from the fixing belt 41 is stored. The reference data is the temperature of the hydraulic fluid 48 in the heat pipes 47.

Figures 11, 12:
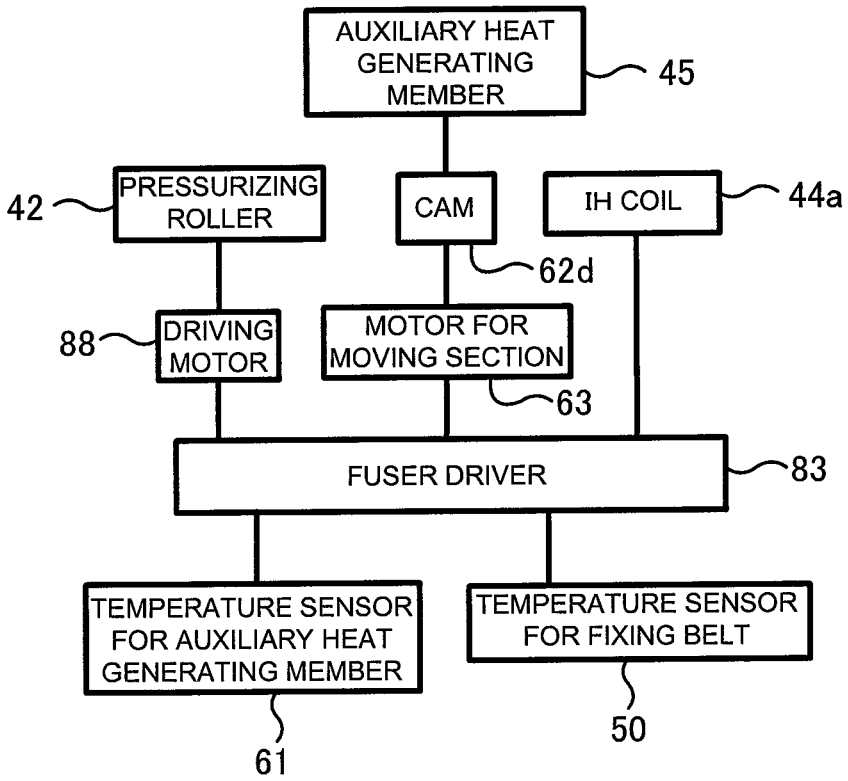
FIG. 11 is a schematic diagram of reference data stored in a ROM.
FIG. 12 is a schematic block diagram for explaining an electrical connection relation of the fuser.

FIG. 11 is a schematic diagram of the reference data stored in the ROM 72. The reference data includes, as a set of data, a type of the hydraulic fluid 48 (e.g., pure water, ethanol, methanol, and acetone) and reference temperatures of the respective types of the hydraulic fluid 48 (a separation temperature, which is a reference temperature for separating the auxiliary heat generating member 45 from the fixing belt 41, and a contact temperature, which is a reference temperature for bringing the auxiliary heat generating member 45 into contact with the fixing belt 41). The reference data includes plural sets of such data for each of the types of the hydraulic fluid 48. The reference data is stored as a table for each of the types of the hydraulic fluid 48.

Referring back to FIG. 10, the image forming apparatus 1' includes a display section 75 for inputting various kinds of information to the image forming apparatus 1' or displaying a state of the image forming apparatus 1'. The display section 75 is connected to the CPU 71 via a display driver 76 for driving the display section 75.

As explained above, the image forming apparatus 1' includes the scanner section 4, the printer section 2, and the fuser 60. The scanner section 4 is connected to the CPU 71 via a scanner driver 77 for driving the scanner section 4.

The printer section 2 includes an exposing device 78, a developing device 79, and a transfer device 80. The exposing device 78, the developing device 79, the transfer device 80, and a motor 81 for rotating the toner cartridges 26Y, 26M, 26C, and 26K are connected to the CPU 71 via a print driver 82 for driving each of the exposing device 78, the developing device 79, the transfer device 80, and the motor 81.

The image forming apparatus 1' includes a conveyance, driver 85 for rotating conveying motors 84. The conveyance driver 85 is connected to the CPU 71. The conveyance driver 85 rotates the conveying motors 84 for rotating, for example, the various rollers and the gate 33 shown in FIG. 1.

The image forming apparatus 1' includes a sensor driver 87 for driving various sensors 86. The sensor driver 87 is connected to the CPU 71.

The fuser 60 is connected to the CPU 71 via a fuser driver 83 for driving the fuser 60.

FIG. 12 is a schematic block diagram for explaining an electrical connection relation of the fuser 60 according to the second embodiment. As shown in FIG. 12, the fuser 60 includes the fuser driver 83. Each of the temperature sensor 50 (the temperature sensor for fixing belt 50) that detects the temperature of the fixing belt 41, the temperature sensor for auxiliary heat generating member 61 that detects the temperature of the hydraulic fluid 48 in the heat pipes 47 included in the auxiliary heat generating member 45, a driving motor 88 for rotating the pressurizing roller 42, the motor for moving section 63 for rotating the cam 62*d* of the moving section 62 that moves the auxiliary heat generating member 45, and the IH coil 44*a* of the IH section 44 is connected to the fuser driver 83.

The temperature sensor for fixing belt 50 is driven by the fuser driver 83 to detect the temperature of the fixing belt 41. The temperature sensor for auxiliary heat generating member 61 is driven by the fuser driver 83 to detect the temperature of the hydraulic fluid 48 in the heat pipes 47. Each of the driving motor 88 and the motor for moving section 63 is driven by the fuser driver 83.

Figure 13:
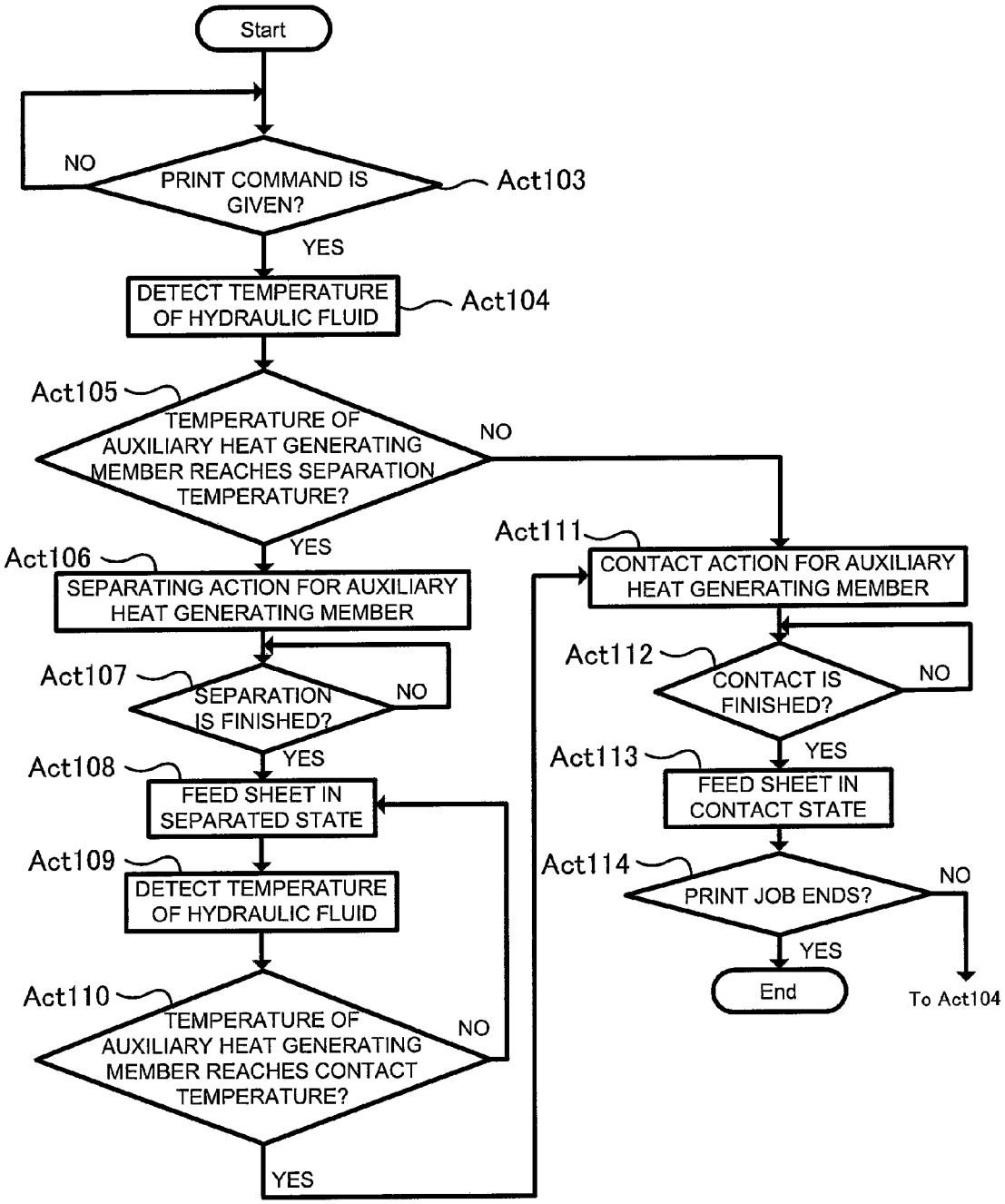
FIG. 13 is a flowchart for explaining an image forming method according to the second embodiment by the image forming apparatus including the fuser according to the second embodiment.

An image forming method by the image forming apparatus 1' including the fuser 60 according to this embodiment is explained with reference to FIG. 13. FIG. 13 is a flowchart for explaining the image forming method.

The CPU 71 determines whether a print command for small-size paper is given (Act 103). A ready state of the image forming apparatus 1' means a state in which the temperature of the fixing belt 41 of the fuser 60 in the image forming apparatus 1' is equal to or higher than a predetermined fixing temperature, i.e., a state in which the fuser 60 can fix a toner image, which is formed on the sheet P, on the sheet P. The small-size paper means the sheet P having the width Ws smaller than the width Wb of the fixing belt 41 as shown in FIG. 4.

When the CPU 71 (FIG. 10) determines that the print command for the small-size paper is given (Yes in Act 103), the CPU 71 instructs the fuser driver 83 to detect the temperature of the hydraulic fluid 48 in the heat pipes using the temperature sensor for auxiliary heat generating member 61 (Act 104).

When the CPU 71 determines that the print command for the small-size paper is not given (No in Act 103), the CPU 71 performs the action in Act 103 again after a predetermined time elapses.

Subsequently, the CPU 71 determines whether the temperature of the hydraulic fluid 48 is equal to or higher than the separation temperature (Act 105). The CPU 71 performs this determination by comparing detected temperature and the separation temperature stored in advance in the ROM 72. When the hydraulic fluid 48 is pure water and the detected temperature is T° C., the CPU 71 determines whether the temperature of the hydraulic fluid 48 is equal to or higher than the separation temperature by comparing the detected temperature T° C. and the separation temperature 210° C. of the pure water (FIG. 11).

When the CPU 71 determines that the detected temperature is equal, to or higher than the separation temperature (Yes in Act 105), the CPU 71 instructs the fuser driver 83 to perform a separating action for the auxiliary heat generating member 45 (Act 106). The separating action is performed as explained below. First, the CPU 71 drives the fuser driver 83 to rotate the motor for moving section 63. The CPU 71 rotates the cam 62*d* according to the rotation of the motor 63 to bring the short side β of the cam 62*d* into contact with the arm 62*b* as shown in FIG. 9. Consequently, the arm 62*b* pivots in the direction indicated by the arrow f in FIG. 9. The auxiliary heat generating member 45 separates from the fixing belt 41.

Subsequently, the CPU 71 determines whether the auxiliary heat generating member 45 is separated from the fixing belt 41 (Act 107). In other words, the CPU 71 determines whether the auxiliary heat generating member 45 is in a state shown in FIG. 9. The CPU 71 only has to perform the determination in Act 107 using a detecting device that can detect a contact state of the auxiliary heat generating member 45 with the fixing belt 41 and a separated state of the auxiliary heat generating member 45 from the fixing belt 41.

When the CPU 71 does not determine that the auxiliary heat generating member 45 is separated from the fixing belt 41 (No in Act 107), the CPU 71 performs the action in Act 107 again after a predetermined time elapses. The CPU 71 returns to the action in Act 106.

When the CPU 71 determines that the auxiliary heat generating member 45 is separated from the fixing belt 41 (Yes in Act 107), the CPU 71 instructs the conveyance driver 85 to feed the sheet P (Act 108). At this point, the auxiliary heat generating member 45 is separated from the fixing belt 41. The CPU 71 applies a print operation to the sheet P.

For example, after a predetermined time elapses from the detection of the temperature of the hydraulic fluid 48 in Act 104, the CPU 71 instructs the fuser driver 83 to detect the temperature of the hydraulic fluid 48 again (Act 109). The CPU 71 determines whether the temperature of the hydraulic fluid 48 is equal to or lower than the contact temperature (Act 110). The CPU 71 performs this determination by, for example, comparing detected temperature and the contact temperature stored in advance in the ROM 72. For example, when the hydraulic fluid 48 is pure water and the detected temperature is T° C., the CPU 71 determines whether the temperature of the hydraulic fluid 48 is equal to or lower than the contact temperature by comparing the detected temperature T° C. and the contact temperature 160° C. of the pure water.

When the CPU 71 determines that the detected temperature is not equal to or lower than the contact temperature (No in Act 110), the CPU 71 returns to the action in Act 108.

When the CPU 71 determines that the detected temperature is equal to or lower than the contact temperature (Yes in Act 110), the CPU 71 performs a contact action for the auxiliary heat generating member 45 (Act 111). The contact action is performed as explained below. First, the CPU 71 drives the fuser driver 83 to rotate the motor for moving section 63. The CPU 71 rotates the cam 62*d* according to the rotation of the motor 63 to bring the long side α of the cam 62*d* into contact with the arm 62*b*. Consequently, the arm 62*b* pivots in the direction indicated by the arrow h in FIG. 8. The auxiliary heat generating member 45 comes into contact with the fixing belt 41.

Subsequently, the CPU 71 determines whether the auxiliary heat generating member 45 is in contact with the fixing belt 41 (Act 112). In other words, the CPU 71 determines whether the auxiliary heat generating member 45 is in contact with the fixing belt 41 as shown in FIG. 8. The CPU 71 only has to perform the determination in Act 112 using a detecting device that can detect a state in which the auxiliary heat generating member 45 is in contact with the fixing belt 41 and a state in which the auxiliary heat generating member 45 is separated from the fixing belt 41.

When the CPU 71 does not determine that the auxiliary heat generating member 45 is in contact with the fixing belt 41 (No in Act 112), the CPU 71 performs the action in Act 112 again after a predetermined time elapses. The CPU 71 returns to the action in Act 111.

When the CPU 71 determines that the auxiliary heat generating member 45 is in contact with the fixing belt 41 (Yes in Act 112), the auxiliary heat generating member 45 instructs the conveyance driver 85 to feed the sheet P to the fuser 60 in a state in which the auxiliary heat generating member 45 is in contact with the fixing belt (Act 113).

Thereafter, the CPU 71 determines whether the print instructed by the print command given in Act 103 ends (Act 114). When the CPU 71 determines that the print instructed by the print command ends (Yes in Act 114), the CPU 71 ends the processing of this flow. When the CPU 71 does not determine that the print instructed by the print command ends (No in Act 114), the CPU 71 returns to the action in Act 104.

In this way, the image forming apparatus 1' forms a copy image on the sheet P. The sheet P having the copy image formed thereon is discharged to the paper discharge section 3. Alternatively, the sheet P is conveyed to the re-conveying unit 32.

In the fuser 60, the image forming apparatus 1', and the image forming method according to this embodiment explained above; as in the first embodiment, the auxiliary heat generating member 45 included in the fuser 60 includes the plural heat pipes 47 sparsely arranged in the center of the auxiliary heat generating member 45 and densely arranged at the ends of the auxiliary heat generating member 45. Therefore, it is possible to suppress the heat distribution in the longitudinal direction of the fixing belt 41 from becoming non-uniform and, when the heat distribution becomes non-uniform, quickly make the heat distribution uniform.

In the fuser 60, the image forming apparatus 1', and the image forming method according to this embodiment explained above, as in the first embodiment, since a heat quantity removed from the center of the fixing belt 41 by the sheet P is small, a temperature drop amount in the center of the fixing belt 41 is also small. Therefore, it is also possible to suppress total electric energy necessary in the fuser 60 and the image forming apparatus 1' including the fuser 60.

Further, in the image forming apparatus 1' and the image forming method according to this embodiment, the auxiliary heat generating member 45 is separated from the fixing belt 41 when the temperature of the hydraulic fluid 48 in the heat pipes 47 rises to be equal to higher than the separation temperature. Therefore, it is possible to cool the hydraulic fluid 48 heated to temperature equal to or higher than the separation temperature. Therefore, it is possible to suppress the hydraulic fluid 48 from, for example, vaporizing to damage heat pipes 47 and the auxiliary heat generating member 45.

Third Embodiment

Figure 14:
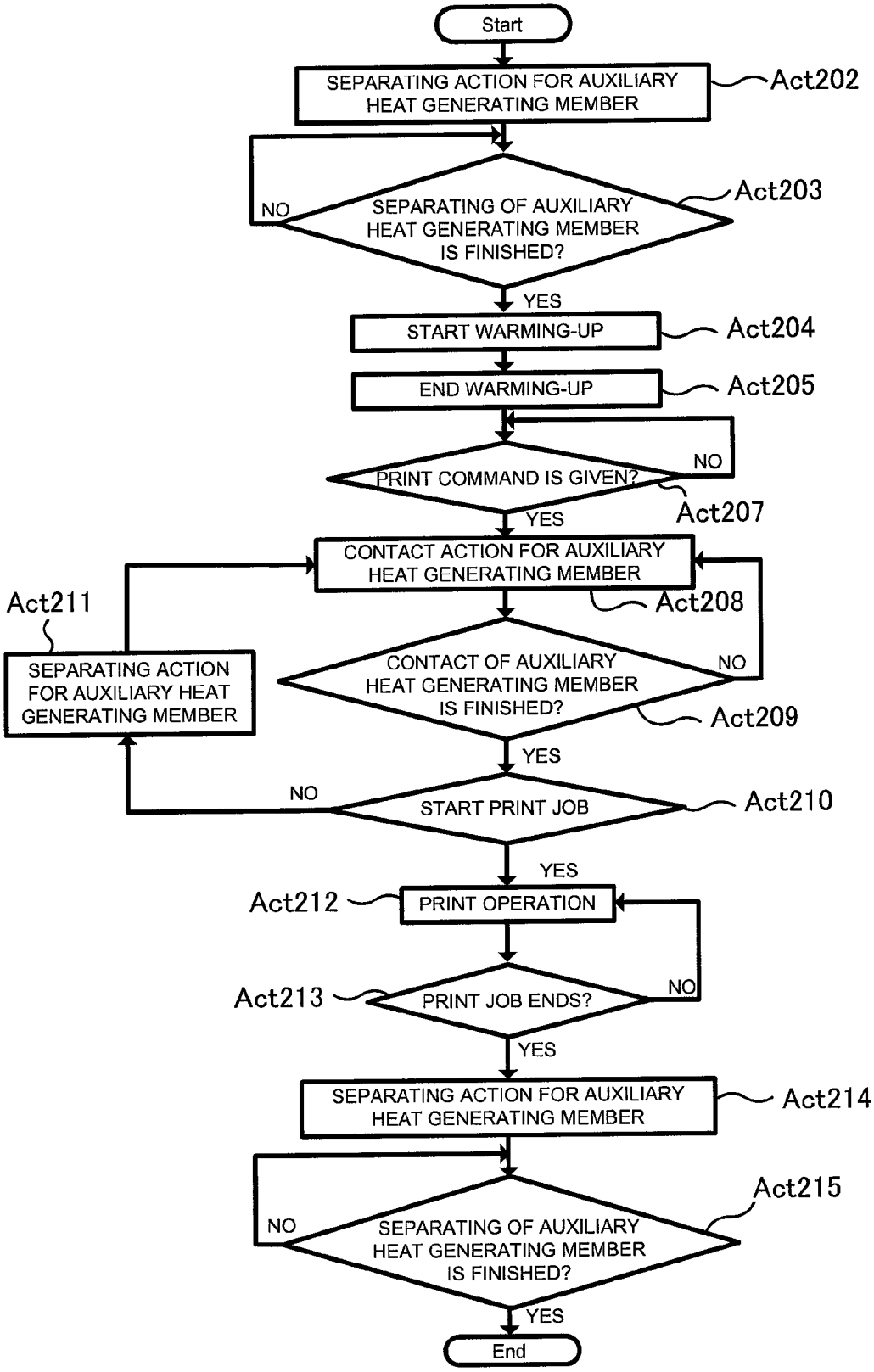
FIG. 14 is a flowchart for explaining an image forming method according to a third embodiment by the image forming apparatus including the fuser according to the second embodiment.

FIG. 14 is a flowchart for explaining an image forming method according to the third embodiment. The image forming method according to the third embodiment is explained below with reference to FIG. 14. A fuser for realizing the image forming method is basically the same as the fuser 60 shown in FIGS. 8 and 9. The image forming apparatus 1' including the fuser 60 is basically the same as the image forming apparatus 1 shown in FIG. 1. Therefore, explanation concerning the fuser and the image forming apparatus for realizing the image forming method according to the third embodiment is omitted.

However, in the image forming method according to the third embodiment explained below, the temperature sensor for auxiliary heat generating member 61 (FIGS. 8 and 9) is not always necessary. In the image forming method according to the third embodiment, the reference data (FIG. 11) serving as a reference for moving the auxiliary heat generating member 45 does not always have to be stored in the ROM 72.

The CPU 71 performs a separating action for the auxiliary heat generating member 45 (Act 202). The CPU 71 only has to perform the action in Act 202 in the same manner as the action in Act 106 in the image forming method according to the second embodiment.

Subsequently, the CPU 71 determines whether the auxiliary heat generating member 45 is separated from the fixing belt 41 (Act 203). In other words, the CPU 71 determines whether the auxiliary heat generating member 45 is in the state shown in FIG. 9. The CPU 71 only has to perform the determination in Act 203 in the same manner as the determination in Act 107 in the image forming method according to the second embodiment.

When the CPU 71 does not determine that the auxiliary heat generating member 45 is separated from the fixing belt 41 (No in Act 203), the CPU 71 performs the action in Act 203 again after a predetermined time elapses.

When the CPU 71 determines that the auxiliary heat generating member 45 is separated from the fixing belt 41 (Yes in Act 203), the CPU 71 causes the fuser driver 83 to start a warming-up action in a state in which the auxiliary heat generating member 45 is separated from the fixing belt 41 (Act 204). In other words, the CPU 71 causes the fuser driver 83 to generate an eddy-current to the IH coil 44*a* until the temperature of the fixing belt 41 reaches a predetermined fixing temperature.

Since the auxiliary heat generating member 45 is separated from the fixing belt 41 during the heating of the fixing belt 41, the heat capacity of the fixing belt 41 is small. Therefore, the fixing belt 41 is quickly heated to the predetermined fixing temperature. When the auxiliary heat generating member 45 is in contact with the fixing belt 41 during the heating of the fixing belt 41, heat supplied to the fixing belt 41 is removed by the auxiliary heat generating member 45. Therefore, a long time is required until the temperature of the fixing belt 41 reaches the predetermined fixing temperature.

When the warming-up action ends (Act 205), i.e., when the temperature of the fixing belt 41 reaches the predetermined fixing temperature, the CPU 71 changes to a state in which the CPU 71 can perform image formation at any time. In other words, the CPU 71 causes the fuser driver 83 to stop generation of the eddy-current to the IH coil 44*a*. The image forming apparatus 1' changes to the ready state.

The CPU 71 determines whether a print command is given (Act 207). When the CPU 71 determines that the print command is given (Yes in Act 207), the CPU 71 instructs the fuser driver 83 to perform a contact action for the auxiliary heat generating member 45 (Act 208). The CPU 71 only has to perform the action in Act 208 in the same manner as the action in Act 111 in the image forming method according to the second embodiment.

Subsequently, the CPU 71 determines whether the auxiliary heat generating member 45 is in contact with the fixing belt 41 (Act 209). In other words, the CPU 71 determines whether the auxiliary heat generating member 45 is in a state in which the auxiliary heat generating member 45 is in contact with the fixing belt 41 as shown in FIG. 9. The CPU 71 only has to perform the determination in Act 209 in the same manner as the determination in Act 112 in the image forming method according to the second embodiment.

When the CPU 71 does not determine that the auxiliary heat generating member 45 is in contact with the fixing belt 41 (No in Act 209), the CPU 71 returns to the action in Act 208.

When the CPU 71 determine that the auxiliary heat generating member 45 is in contact with the fixing belt 41 (Yes in Act 209), in a state in which the auxiliary heat generating member 45 is in contact with the fixing belt 41, the CPU 71 determines whether to start a print operation (Act 210).

When the CPU 71 does not determine to start the print operation (No in Act 210), the CPU 71 instructs the fuser driver 83 to perform the separating action for the auxiliary heat generating member 45 (Act 211). The CPU 71 returns to the action in Act 208.

When the CPU 71 determines to start the print operation (Yes in Act 210), the CPU 71 applies the print operation to the sheet P (Act 212). The CPU 71 only has to perform the print operation in Act 212 in the same manner as the print operation in Act 108 in the image forming method according to the second embodiment.

Thereafter, the CPU 71 determines whether the print instructed by the print command given in Act 207 ends (Act 213). When the CPU 71 does not determine that the print instructed by the print command ends (No in Act 213), the CPU 71 returns to the action in Act 212.

When the CPU 71 determines that the print instructed by the print command ends (Yes in Act 213), the CPU 71 instructs the fuser driver 83 to perform the separating action for the auxiliary heat generating member 45 (Act 214). The CPU 71 determines whether the auxiliary heat generating member 45 is separated from the fixing belt 41 (Act 215).

When the CPU 71 does not determine that the auxiliary heat generating member 45 is separated from the fixing belt 41 (No in Act 215), the CPU 71 performs the action in Act 215 again after a predetermined time elapses.

When the CPU 71 determines that the auxiliary heat generating member 45 is separated from the fixing belt 41 (Yes in Act 215), the CPU 71 ends this flow.

In this way, the image forming apparatus 1' forms a copy image on the sheet P. The sheet P having the copy image formed thereon is discharged to the paper discharge section 3. Alternatively, the sheet P is conveyed to the re-conveying unit 32.

The sheet P conveyed to the re-conveying unit 32 is conveyed to the printer section 2 again. The printer section 2 forms a toner image on the sheet P. The fuser 60 fixes the toner image on the sheet P. Thereafter, the sheet P is discharged to the paper discharge section 3.

The image forming method explained above is executed by the CPU 71 according to the control program stored in the ROM 72.

With the image forming method according to this embodiment explained above, the auxiliary heat generating member 45 is separated from the fixing belt 41 until the temperature of the fixing belt 41 reaches the predetermined fixing temperature. Therefore, the fixing belt 41 can be heated without heat supplied to the fixing belt 41 being removed by the auxiliary heat generating member 45. Therefore, it is possible to quickly heat the fixing belt 41 to the predetermined fixing temperature. In other words, it is possible to reduce a warming-up time compared with a warming-up time required when the auxiliary heat generating member 45 is always in contact with the fixing belt 41.

The reduction in the warming-up time that can be realized by the image forming method according to this embodiment is further explained below.

Figure 15:
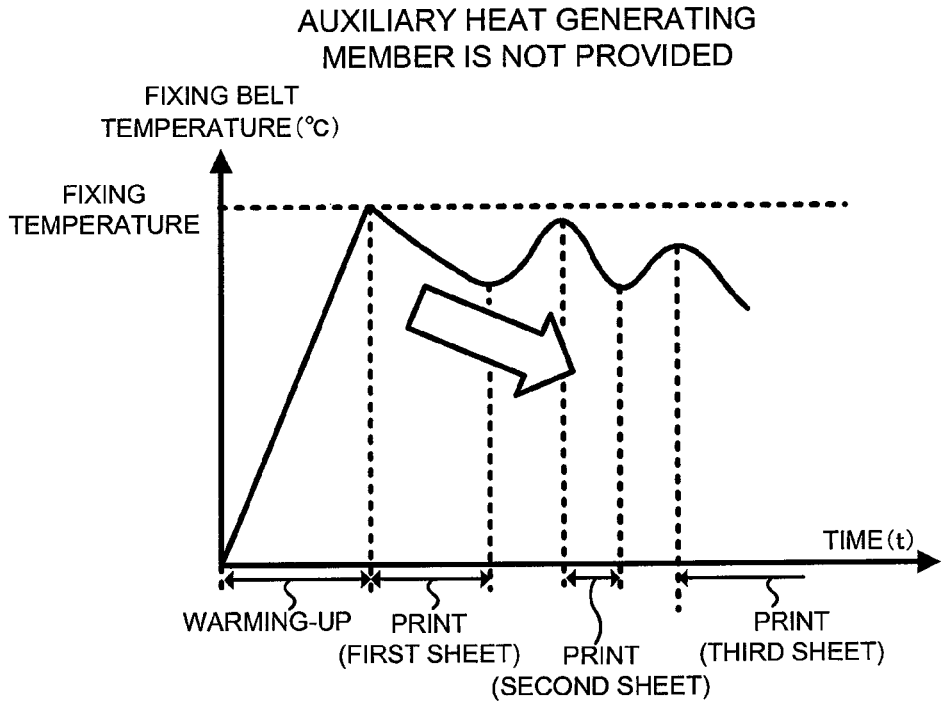
FIG. 15 is a schematic diagram of temperature transition of a fixing belt that occurs when image formation is performed by an image forming apparatus not including an auxiliary heat generating member.

FIG. 15 is a schematic diagram of temperature transition of a fixing belt that occurs when image formation is performed by an image forming apparatus not including an auxiliary heat generating member. In the figure, the abscissa indicates time and the ordinate indicates the temperature of the fixing belt.

When a fuser in the image forming apparatus does not include an auxiliary heat generating member, heat supplied to the fixing belt during warming-up is not removed by the auxiliary heat generating member. Therefore, as shown in FIG. 15, the temperature of the fixing belt relatively quickly reaches a predetermined fixing temperature. In other words, time required for the warming-up is relatively short.

However, since the fixing belt may not able to be heated by the auxiliary heat generating member, the temperature of the fixing belt drops every time a print operation is executed, i.e., every time a sheet passes on the fixing belt. As a result, a warming-up action has to be executed every time print of plural sheets is executed.

Figure 16:
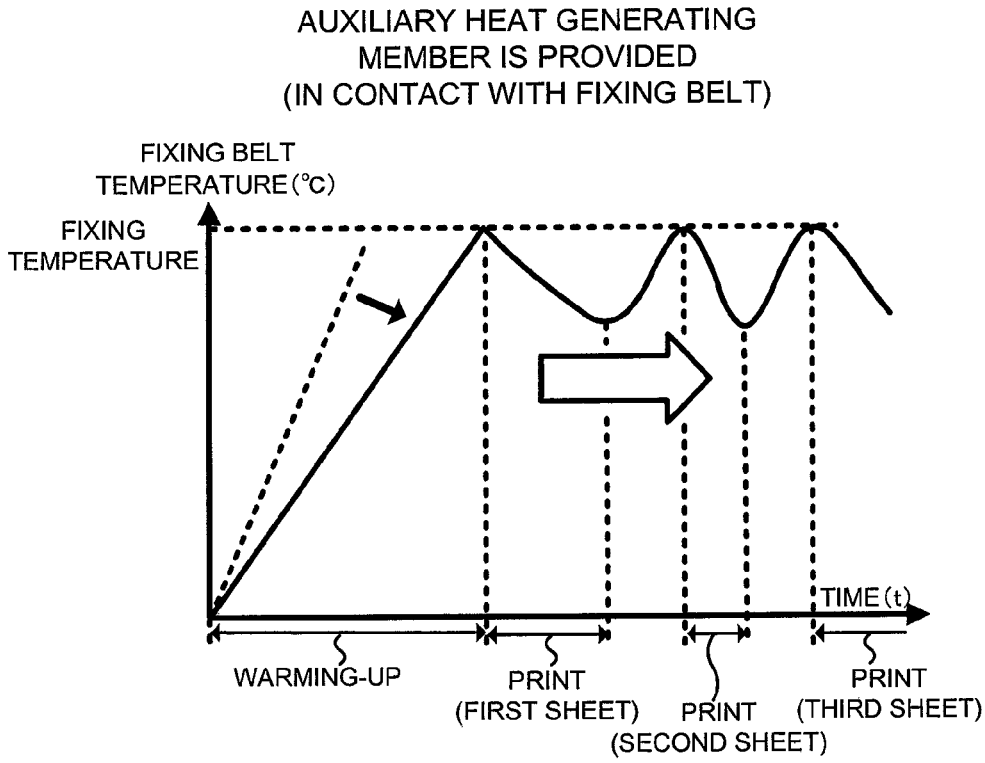
FIG. 16 is a schematic diagram of temperature transition of a fixing belt that occurs when image formation is performed by an image forming apparatus in which an auxiliary heat generating member is always in contact with a fixing belt.

FIG. 16 is a schematic diagram of temperature transition of a fixing belt that occurs when image formation is performed by an image forming apparatus in which an auxiliary heat generating member is always in contact with a fixing belt. In the figure, the abscissa indicates time and the ordinate indicates the temperature of the fixing belt.

When the auxiliary heat generating member is always in contact with the fixing belt, the fixing belt can be heated by the auxiliary heating member. Therefore, as shown in FIG. 16, when a print operation is executed plural times, it is possible to suppress a drop of the temperature of the fixing belt.

However, since heat supplied to the fixing belt during warming-up is removed by the auxiliary heat generating member, time required for the warming-up increases.

Figure 17:
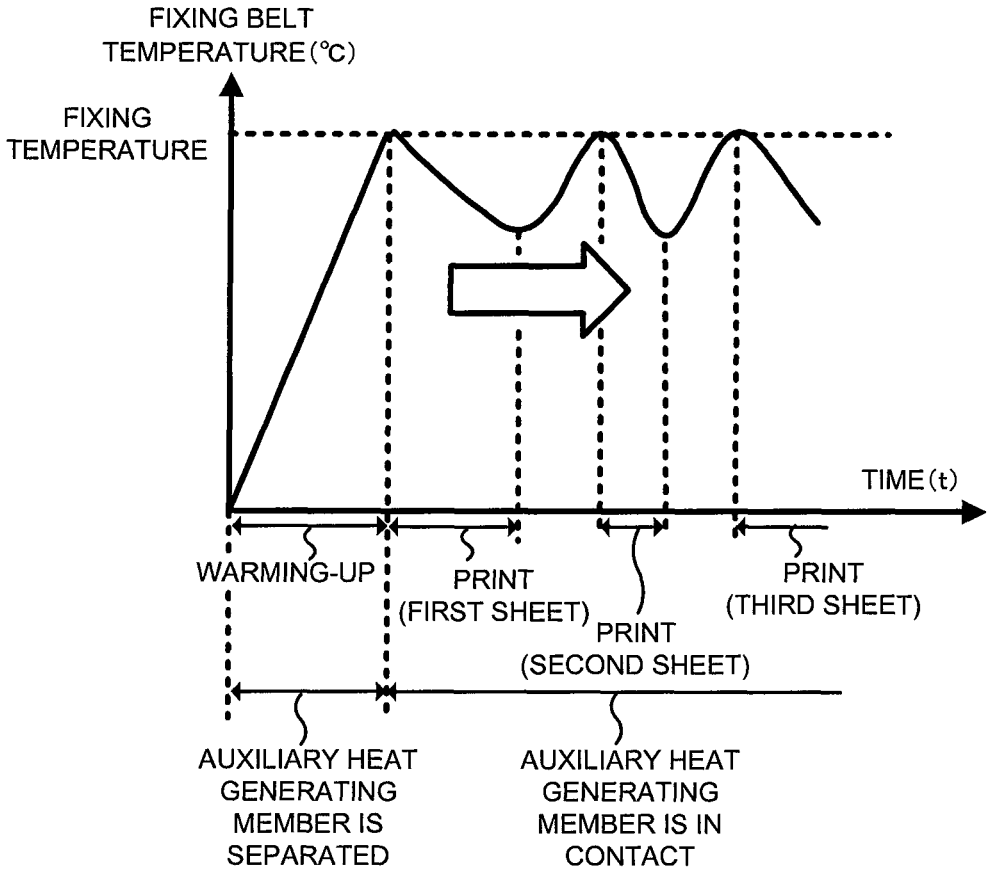
FIG. 17 is a schematic diagram of temperature transition of a fixing belt that occurs when image formation is performed by the image forming method according to the third embodiment.

FIG. 17 is a schematic diagram of temperature transition of a fixing belt that occurs when image formation is performed by the image forming method according to the third embodiment. In the figure, the abscissa indicates time and the ordinate indicates the temperature of the fixing belt.

With the image forming method according to this embodiment, since the auxiliary heat generating member 45 is separated from the fixing belt 41 during the warming-up, heat supplied to the fixing belt 41 during the warming-up is prevented from being removed by the auxiliary heat generating member 45. Therefore, time required for the warming-up is as short as the warming-up time shown in FIG. 15.

Further, since the auxiliary heat generating member 45 is in contact with the fixing belt 41 during the print operation, the fixing belt 41 can be heated by the auxiliary heat generating member 45 during the print operation. Therefore, when the print operation is executed plural times, it is possible to suppress a drop of the temperature of the fixing belt 41.

As explained above, with the image forming method according to this embodiment, it is possible to suppress a drop of the temperature of the fixing belt 41 during the print operation and reduce the warming-up time.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fuser comprising:

a cylindrical fixing belt;

a heating member configured to heat the fixing belt;

an auxiliary heat generating member configured to heat the fixing belt;

a plurality of heat pipes arranged in a longitudinal direction of the auxiliary heat generating member, each of the plurality of heat pipes having a first end positioned near a first edge of the auxiliary heat generating member, a second end positioned near a second edge of the auxiliary heat generating member, and a center positioned near a center of the auxiliary heat generating member in the longitudinal direction, the first ends and the second ends being more densely arranged compared to the centers;

a pressurizing pad arranged on an inside of the fixing belt; and a pressurizing roller arranged in contact with an outer circumference of the fixing belt and configured to press the fixing belt against the pressurizing pad.

2. The fuser according to claim 1, wherein the plurality of heat pipes include a linear heat pipe and a plurality of curved heat pipes curved in a direction perpendicular to the longitudinal direction of the auxiliary heat generating member, the linear heat pipe is arranged along the longitudinal direction of the auxiliary heat generating member, and each of the plurality of curved heat pipes is arranged on one of both sides of the linear heat pipe.

3. The fuser according to claim 1, wherein the auxiliary heat generating member includes an auxiliary heat generating layer heated by the heating member, and the plurality of heat pipes are provided in the auxiliary heat generating layer.

4. The fuser according to claim 3, wherein each of the plurality of heat pipes is made of cylindrical metal, and each of the plurality of heat pipes made of the cylindrical metal is provided on an inside of the auxiliary heat generating layer.

5. The fuser according to claim 1, wherein the auxiliary heat generating member is movable between a first position where the auxiliary heat generating member comes into contact with an inner circumferential surface of the fixing belt and a second position where the auxiliary heat generating member separates from the inner circumferential surface of the fixing belt.

6. An image forming apparatus comprising:

an image forming section configured to form a toner image on a recording medium;

a cylindrical fixing belt arranged to contact the toner image;

a heating member configured to heat the fixing belt;

an auxiliary heat generating member configured to heat the fixing belt;

a plurality of heat pipes arranged in a longitudinal direction of the auxiliary heat generating member, each of the plurality of heat pipes having a first end positioned near a first edge of the auxiliary heat generating member, a second end positioned near a second edge of the auxiliary heat generating member, and a center positioned near a center of the auxiliary heat generating member in the longitudinal direction, the first ends and the second ends being more densely arranged compared to the centers;

a pressurizing pad arranged on an inside of the fixing belt; and a pressurizing roller arranged in contact with an outer circumference of the fixing belt and configured to press the fixing belt against the pressurizing pad.

7. The apparatus according to claim 6, wherein the plurality of heat pipes include a linear heat pipe and a plurality of curved heat pipes curved in a direction perpendicular to the longitudinal direction of the auxiliary heat generating member, the linear heat pipe is arranged along the longitudinal direction of the auxiliary heat generating member, and each of the plurality of curved heat pipes is arranged on one of both sides of the linear heat pipe.

8. The apparatus according to claim 6, wherein the auxiliary heat generating member includes an auxiliary heat generating layer heated by the heating member, and the plurality of heat pipes are provided in the auxiliary heat generating layer.

9. The apparatus according to claim 8, wherein each of the plurality of heat pipes is made of cylindrical metal, and each of the plurality of heat pipes made of the cylindrical metal is provided on an inside of the auxiliary heat generating layer.

10. The apparatus according to claim 9, wherein each of the plurality of heat pipes includes, on an inside thereof, hydraulic fluid for transmitting heat.

11. The apparatus according to claim 10, further comprising a temperature sensor configured to detect a temperature of the hydraulic fluid.

12. The apparatus according to claim 10, further comprising a temperature sensor configured to detect temperature of a surface of the heat pipes.

13. The apparatus according to claim 11, wherein the auxiliary heat generating member is movable between a first position where the auxiliary heat generating member comes into contact with an inner circumferential surface of the fixing belt and a second position where the auxiliary heat generating member separates from the inner circumferential surface of the fixing belt.

14. The apparatus according to claim 13, further comprising a moving section configured to move the auxiliary heat generating member, wherein the moving section moves the auxiliary heat generating member on the basis of the temperature detected by the temperature sensor for auxiliary heat generating member.

15. An image forming method comprising:

detecting, using a temperature sensor a temperature of hydraulic fluid in a plurality of heat pipes, each made of cylindrical metal, arranged in a longitudinal direction of an auxiliary heat generating member, and configured to heat a fixing belt, each of the plurality of heat pipes having an end positioned near an edge of the auxiliary heat generating member, and a center positioned near a center of the auxiliary heat generating member in the longitudinal direction, the ends being more densely arranged compared to the centers;

separating, with a moving section configured to move the auxiliary heat generating member, the auxiliary heat generating member from the fixing belt when the detected temperature is equal to or higher than a separation temperature;

forming a toner image on a recording medium; and fixing the toner image on the recording medium by supplying the recording medium to a nip portion formed in the fixing belt having a temperature equal to or higher than a predetermined fixing temperature.

16. The method according to claim 15, further comprising forming the toner image on the recording medium in a state in which the auxiliary heat generating member is separated from the fixing belt and fixing the toner image on the recording medium by supplying the recording medium to the nip portion formed in the fixing belt when the temperature is equal to or higher than the predetermined fixing temperature.

17. The method according to claim 15, further comprising:

further detecting, using the temperature sensor, temperature of the hydraulic fluid in the plurality of heat pipes in a state in which the auxiliary heat generating member is separated from the fixing belt; and bringing, with the moving section, the auxiliary heat generating member into contact with the fixing belt when the detected temperature is equal to or lower than a contact temperature.

18. The method according to claim 17, further comprising forming the toner image on the recording medium in a state in which the auxiliary heat generating member is in contact with the fixing belt and fixing the toner image on the recording medium by supplying the recording medium to the nip portion formed in the fixing belt having the temperature equal to or higher than the predetermined fixing temperature.

* * * * *